US005443933A

United States Patent [19]

Fujimori et al.

[11] Patent Number: 5,443,933

[45] Date of Patent: Aug. 22, 1995

[54] ELECTROPHOTOGRAPHIC PHOTORECEPTOR

[75] Inventors: Kenichi Fujimori; Yoshitaro Nakayama, both of Yamanashi; Takumi Shinohara; Atsushi Iwanami, both of Kofu; Toshimitsu Hagiwara; Tohru Kobayashi, both of Hiratsuka, all of Japan

[73] Assignees: Shindengen Electric Manufacturing Co., Ltd., Tokyo; Yamanashi Electronics Co., Ltd., Yamanashi; Takasago International Corporation, Tokyo, all of Japan

[21] Appl. No.: 118,823

[22] Filed: Sep. 10, 1993

[30] Foreign Application Priority Data

Sep. 18, 1992 [JP] Japan ..... 4-249679

[51] Int. Cl.[6] ..... G03G 5/047

[52] U.S. Cl. ..... 430/59; 430/74

[58] Field of Search ..... 430/59, 74

[56] References Cited

U.S. PATENT DOCUMENTS 4,751,163 6/1988 Hagiwara et al. ..... 430/59
5,061,584 10/1991 Fujimori et al. ..... 430/59
5,234,785 8/1993 Itami et al. ..... 430/59

FOREIGN PATENT DOCUMENTS 3136058A 6/1991 Japan .
3253861A 11/1991 Japan .

*Primary Examiner*—Christopher D. Rodee
*Attorney, Agent, or Firm*—Stevens, Davis, Miller & Mosher

[57] ABSTRACT

An electrophotographic photoreceptor which is highly sensitive to light having a wavelength in the oscillatory wavelength region of semiconductor laser and responds quickly and is excellent in other electrophotographic characteristics and which consists an electroconductive support, a charge-generating layer and a charge-transfer layer, the two layers being placed on the support, and said charge-transfer layer containing a specific butadiene compound having formula (I);

(I)

and a monophenol type antioxidant, the weight ratio of the monophenol type antioxidant/the butadiene compound ranging from 5/95 to 40/80.

8 Claims, 1 Drawing Sheet

ELECTROPHOTOGRAPHIC PHOTORECEPTOR

BACKGROUND OF THE INVENTION

This invention relates to an electrophotographic photoreceptor, and more particularly to an electrophotographic photoreceptor using an organic photoconductive material.

Generally used as photoconductive materials for electrophotographic photoreceptors are inorganic materials such as selenium (Se), cadmium sulfide (CdS), zinc oxide (ZnO), amorphous silicon (a—Si) and the like. Photoreceptors using such inorganic photoconductive materials are used in such a manner that the photoreceptors are charged in the dark by means of, for example, a charging roller and then subjected to imagewise exposure to selectively neutralize the charges only on the exposed portions, and the electrostatic latent image thus formed is thereafter visualized with a developer to form an image. Such photographic photoreceptors are basically required to have (1) an ability to be charged to an adequate potential in the dark and (2) a function of neutralizing the surface charges by exposure to light. However, the above-mentioned inorganic photoconductive materials have merits and demerits and, for example, selenium (Se) satisfies sufficiently the requirements (1) and (2) but is inflexible and difficult to mold into a film. In addition, it is sensitive to mechanical impact and hence must be carefully handled. Amorphous silicon (a—Si) has such a demerit that severe production conditions are required and hence its production cost becomes high.

Recently, function-separated type organic photoreceptors have been mainly used which have a charge-generating layer consisting of a phthalocyanine compound or an azo compound which is known as an organic photo-conductive material having laminated thereto a charge-transfer layer consisting of a hydrazone compound or the like.

In such organic photoreceptors, charge-transfer materials which are effective to a specific charge-generating material are not always effective to other charge-generating materials. That is, it is necessary to adequately combine a charge-generating material with a charge-transfer material, and if the combination is inadequate it will be impossible to obtain an electrophotographic photoreceptor excellent in characteristics such as sensitivity and the like.

On the other hand, a laser printer has recently been extensively developed which uses as a light source a semiconductor laser having a wavelength in the near infrared region. The electrophotographic photoreceptors applied to this field are required to have high sensitivity to light having a wavelength in the oscillatory wavelength region of a semiconductor laser (about 760–850 nm), and simultaneously, a short response time which is the time required until the charges are neutralized by exposure to light becomes a great factor required for the photoreceptor.

For meeting said requirement, attention is directed to a phthalocyanine compound among charge-generating materials because it is sensitive to semiconductor wavelength region.

Of phthalocyanine pigments, metalophthalocyanine compounds have been much studied, and hydroxytitanium phthalocyanines having different crystal forms have been reported as particularly useful compounds. However, the film formed from the above phthalocyanine is chemically instable, and when it is contacted with, for example, a solvent its crystal form is changed, whereby a great difference is caused in respect of electrophotographic characteristics such as charge potential, residual potential and the like. A solution of this problem has been strongly desired.

However, there have been found neither phthalocyanine compounds as charge-generating materials excellent in electrophotographic characteristics in the oscillatory wavelength region of semiconductor laser nor charge-transfer materials to be adequately combined with the phthalocyanine compounds.

In order to solve the above problems of prior art, the present inventors have made extensive research on various organic compounds as the charge-transfer materials to be combined with the phthalocyanine compound as the charge-generating material to find that a specific butadiene compound is very effective to enhance the electrophotographic characteristics, and as a result, have obtained a photoreceptor having high sensitivity and excellent light responsibility.

SUMMARY OF THE INVENTION

It is an object of this invention to provide an electrophotographic photoreceptor freed from the above-mentioned disadvantages of the prior art, particularly having high sensitivity to light having a wavelength in the oscillatory wavelength region of semiconductor laser and having a short response time.

It is another object of the invention to provide an electrophotographic photoreceptor excellent in electrophotographic characteristics such as charge potential, residual potential and the like.

Other objects and advantages of this invention will become apparent from the following description.

According to this invention, there is provided a laminate type electrophotographic photoreceptor having a charge-generating layer and a charge-transfer layer on a photoconductive support, said charge-generating layer containing a hydroxytitanium phthalocyanine and the charge-transfer layer containing a butadiene compound represented by formula (I);

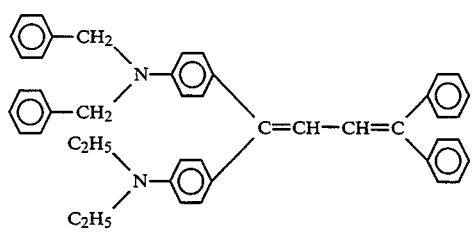

(I)

In this invention, the charge-transfer layer further contains a monophenol type antioxidant, the weight ratio of the monophenol type antioxidant/the compound of formula (I) ranging from 5/95 to 40/80.

DETAILED DESCRIPTION OF THE INVENTION

When the charge-generating layer is formed from a hydroxytitanium phthalocyanine having a main peak at a black angle ($2\theta \pm 0.2°$) of 27.3° in the X-ray diffraction spectrum, very good characteristics as an electrophotographic photoreceptor are obtained. In particular, the photoreceptor having said charge-generating layer has high sensitivity to light having a wavelength in the oscillatory wavelength region of semiconductor laser and has a very low residual potential.

The charge-transfer material used in this invention is a butadiene compound represented by the above-mentioned formula (I) and is dissolved in an electrically insulating binder.

The proportions of the components in the charge-transfer layer in this invention are preferably such that the weight ratio of the compound of formula (I)/the binder ranges from 0.5/1.0 to 1.2/1.0 and the weight ratio of the monophenol type antioxidant/the compound of formula (I) ranges from 5/95 to 40/80, preferably from 5/95 to 20/80, in order to obtain much better light responsibility than conventional organic photoreceptors.

In this invention, the charge-transfer layer containing a monophenol type antioxidant may be formed by adding the monophenol type antioxidant to the butadiene compound represented by formula (I), dissolving the resulting mixture in the binder and forming the resulting solution into a film. In the film thus formed, the internal stress is reduced and no cracks are caused even when a stimulus due to adhesion of an oil, a fingerprint or the like is given thereto. The amount of the mono-phenol type antioxidant added is preferably 5–20 parts by weight per 100 parts by weight of the total amount of the antioxidant and the butadiene compound of formula (I). When the amount is less than 5 parts by weight, cracks tend to be caused and the chargeability tends to become low. On the other hand, when the amount exceeds 20 parts by weight, the residual potential tends to become high.

The monophenol type antioxidant includes 2-tert-butyl-4-methoxyphenol, 2,6-di-tert-butylphenol, 2,6-di-tert-butyl-4-methylphenol, 2,6-di-tert-butyl-4-ethylphenol and 2,6-di-tert-butyl-4-methoxyphenol. Other antioxidants such as polyphenol type antioxidants, bisphenol type antioxidants, amine type antioxidants, salicylic acid type photostabilizers, benzophenone type photostabilizers and the like cannot be used in this invention because with the polyphenol type antioxidants cracks are caused owing to adhesion of an oil, a fingerprint or the like, and with the bisphenol type antioxidants, amine type antioxidants, salicylic acid type antioxidants and benzophenone type photostabilizers, the formation of cracks can be inhibited but the residual potential becomes high and hence the function as a photoreceptor is deteriorated.

Figure 1:
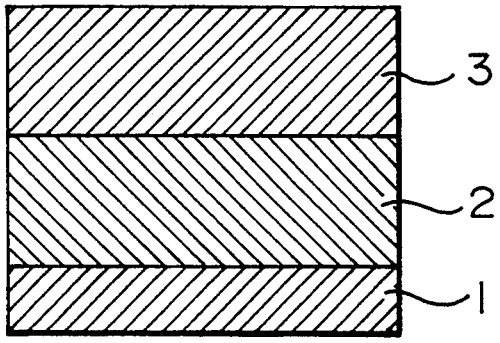
FIG. 1 shows a cross-sectional view of a negatively charged photoreceptor according to this invention.
Figure 2:
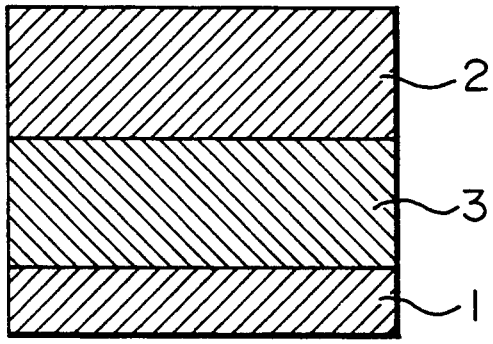
FIG. 2 shows a cross-sectional view of a positively charged photoreceptor according to this invention.

The structure of the electrophotographic photoreceptor of this invention is as shown in FIGS. 1 and 2, and FIG. 1 shows a negatively charged, function-separated type, double layer structure in which a charge-generating layer 2 is formed on a substrate 1 and a charge-transfer layer 3 is formed on the charge-generating layer 2. FIG. 2 shows a positively charged, double layer structure in which a charge-transfer layer 3 is formed on a substrate 1, a charge-generating layer 2 is formed on the charge-transfer layer 3. Incidentally, in this invention, in each of FIGS. 1 and 2, a further charge-transfer layer may, if necessary, be formed and an undercoat layer may, if necessary, be provided on the substrate.

The electrophotographic photoreceptor of this invention which has the structure of FIG. 1 consisting of the substrate 1, the charge-generating layer 2 and the charge-transfer layer 3 is prepared by dissolving the butadiene compound of formula (I), namely 1-p-dibenzylaminophenyl-1-p-diethylaminophenyl-4,4-diphenyl-1,3-butadiene, a monophenol type antioxidant and an electrically insulating binder in a suitable solvent to prepare a coating solution, and coating the coating solution on the charge-generating layer 2 formed on the support in the following manner.

The charge-generating layer applied to this invention may be prepared by vapor-depositing the above-mentioned specific hydroxytitanium phthalocyanine or coating a dispersion thereof in a binder on the support. When the vapor-deposition is effected, it is deposited in a film thickness of 100–3,000 Å, and then immersed in an alcohol such as methanol or the like at a temperature of 25°–40° C. for a period of 1–10 seconds to cause crystal modification into a crystal form having a main peak at a black angle ($2\theta \pm 0.2°$) of 27.3° in the X-ray diffraction spectrum. In the case of the dispersion-coating method, the charge-generating layer may be formed by treating a hydroxytitanium phthalocyanine to convert the same into an amorphous crystal, milling the same in an alcoholic solvent to convert the same into a crystal system having a main peak at a black angle of 27.3° of the X-ray diffraction spectrum, adding a ketone type solvent in which the crystal system is well dispersed, to disperse the crystal system in the solvent and then coating the resulting dispersion of a hydroxytitanium phthalocyanine on the support.

The electrically insulating binder includes thermoplastic resins such as polyester, polycarbonate, polyvinyl chloride, polyvinyl butyral, acrylic resin and the like, and these may be used alone or in admixture of two or more.

The solvent for preparing the coating solution includes ethers such as tetrahydrofuran, dioxane and the like; ketones such as methyl ethyl ketone, cyclohexanone and the like; alcohols such as methanol and the like; aromatic hydrocarbons such as toluene and the like; and chlorinated hydrocarbons such as methylene chloride and the like. These may be used alone or in admixture of two or more.

The electroconductive support includes plate and drum of aluminum, nickel and the like; plastic film having vapor-deposited or plated thereon a metal such as aluminum, copper, nickel or the like; and sheet and drum of a mixture of a plastic material and electroconductive powder such as carbon powder.

DESCRIPTION OF PREFERRED EMBODIMENTS

This invention is explained in more detail below, referring to Examples which are merely by way of illustration and not by way of limitation.

Example 1

A dispersion of a hydroxytitanium phthalocyanine in polyvinyl butyral BM-1 (manufactured by Sekisui Kagaku Kogyo K.K.) as a binder was applied to an aluminum drum by dip coating in a thickness of 0.1 μm to form a charge-generating layer. Subsequently, 1-p-dibenzylaminophenyl-1-p-diethylaminophenyl-4,4-diphenyl-1,3-butadiene/polycarbonate Z (Mitubishi Gas Chemical Co., Ltd.) =0.8/1.0 by weight and 2,6-di-tert-butyl-4-methylphenol/1-p-diebenzylaminophenyl -1-p-diethylaminophenyl-4,4-diphenyl-1,3-butadiene=5/95 by weight were dissolved in chloroform to prepare a coating solution, the resulting coating solution was applied onto the charge-generating layer by dip coating and the resulting coating was dried at 100° C. for one hour to form a charge-transfer layer having a film thickness of 20 μm, whereby a photoreceptor was formed.

Example 2

A hydroxytitanium phthalocyanine was heated at a vacuum of $10^{-6}$ mmHg to vapor-deposit the same on an aluminum drum in a thickness of 2 μm to form a charge-generating layer. Subsequently, in the same manner as in Example 1, a charge-transfer layer was formed thereon to prepare a photoreceptor.

Comparative Example 1

The same procedure as in Example 1 was repeated, except that the 1-p-dibenzylaminophenyl-1-p-diethylaminophenyl-4,4-diphenyl-1,3-butadiene was replaced with o-methyl-p-dibenzylaminobenzaldehyde(-diphenylhydrazone) to prepare a photoreceptor.

Comparative Example 2

The same procedure as in Example 1 was repeated, except that p-diethylaminobenzaldehyde(diphenylhydrazone) was substituted for the 1-p-dibenzylaninophenyl-1-p-diethylaminophenyl-4,4-diphenyl-1,3-butadiene to prepare a photoreceptor.

Comparative Example 3

The same procedure as in Example 1 was repeated, except that 1,1-bis(p-diethylaminophenyl)-4,4-diphenyl-1,3-butadiene was substituted for the 1-p-benzylaminophenyl-1-p-diethylaminophenyl-4,4-diphenyl-1,3-butadiene to prepare a photoreceptor.

Comparative Example 4

The same procedure as in Example 1 was repeated, except that the 2,6-di-tert-butyl-4-methylphenol was not used to prepare a photoreceptor.

Comparative Example 5

The same procedure as in Example 1 was repeated, except that N-phenyl-1-naphthylamine as an amine type antioxidant was substituted for the 2,6-di-tert-butyl-4-methylphenol in the same amount as the latter to prepare a photoreceptor.

Comparative Example 6

The same procedure as in Example 1 was repeated, except that p-tert-butylphenol salicylate as a salicylic acid type photostabilizer was substituted for the 2,6-di-tert-butyl-4-methylphenol in the same amount as the latter to prepare a photoreceptor.

Comparative Example 7

The same procedure as in Example 1 was repeated, except that 2-hydroxy-4-methoxybenzophenone as a benzophenone type photostabilizer was substituted for the 2,6-di-tert-butyl-4-methylphenol in the same amount as the latter to prepare a photoreceptor.

Comparative Example 8

The same procedure as in Example 1 was repeated, except that an X type metal-free phthalocyanine was substituted for the hydroxytitanium phthalocyanine to prepare a photoreceptor.

The electrophotographic characteristics of the electrophotographic photoreceptors obtained in Examples 1 and 2 and Comparative Examples of 1 to 8 were evaluated by means of a conventional electrophotographic photo-receptor evaluation apparatus. The above photoreceptor was charged at an applied potential of −5 KV, the surface potential $V_0$ was measured, and the photoreceptor was allowed to stand in the dark for 10 seconds, and then exposed to semiconductor laser (λ=78 nm, exposure: 2 erg/cm$^2$), after which the exposure necessary for damping the surface potential to ½ (half-damped exposure) was calculated.

The surface potential, half-damped exposure, dark damping factors, charge potentials, residual potentials and response time determined in the above-mentioned manner are shown in Table 1.

TABLE 1

| | $V_0$ (V) | $E_{f0}$ (μJ/cm$^2$) | $DDR_1$ | $V_{01}$ (V) | $V_{R1}$ (V) | $V_{02}$ (V) | $V_{R2}$ (V) | $DDR_2$ | Response time (sec) |
|---|---|---|---|---|---|---|---|---|---|
| Example 1 | 720 | 0.1 | 0.90 | 720 | 10 | 720 | 10 | 0.88 | 0.1 |
| Example 2 | 700 | 0.1 | 0.90 | 700 | 10 | 700 | 10 | 0.85 | 0.1 |
| Comp. Ex. 1 | 700 | 0.3 | 0.90 | 700 | 50 | 690 | 50 | 0.85 | 0.3 |
| Comp. Ex. 2 | 700 | 0.2 | 0.90 | 700 | 40 | 690 | 40 | 0.85 | 0.3 |
| Comp. Ex. 3 | 650 | 0.1 | 0.80 | 700 | 10 | 650 | 10 | 0.75 | 0.15 |
| Comp. Ex. 4 | 620 | 0.1 | 0.82 | 700 | 10 | 670 | 10 | 0.77 | 0.1 |
| Comp. Ex. 5 | 720 | 0.1 | 0.90 | 720 | 25 | 720 | 30 | 0.88 | 0.15 |
| Comp. Ex. 6 | 720 | 0.1 | 0.90 | 720 | 30 | 720 | 30 | 0.90 | 0.15 |
| Comp. Ex. 7 | 720 | 0.1 | 0.90 | 720 | 30 | 720 | 30 | 0.90 | 0.15 |
| Comp. Ex. 8 | 720 | 0.3 | 0.90 | 720 | 30 | 720 | 30 | 0.85 | 0.1 |

Note:
$V_0$: Surface potential (at an applied voltage of −5 KV)
$E_{f0}$: Half-damped exposure (650 KV, 780 nm)
$DDR_1$: Dark damping factor (initial, for 10 sec)
$DDR_2$: Dark damping factor (after 200 cycles, for 10 sec)
$V_{01}$: Initial charge potential
$V_{02}$: Charge potential after 200 cycles
$V_{R1}$: Initial residual potential
$V_{R2}$: Residual potential after 200 cycles
Response time: Light-response time of charge As is clear from Table 1, when 1-p-dibenzylaminophenyl-1-p-diethylaminophenyl-4,4-diphenyl-1,3-butadiene was used as the charge-transfer material, the residual potential was particularly low, and the response time was short. Comparative Example 3 is good in residual potential but inferior in chargeability and dark damping factor. Comparative Example 4 is the case where 2,6-di-tert-butyl-4-methylphenol was not added, in which the chargeability was inferior. With other additives, the chargeability is enhanced, but the residual potential becomes high, and also the response time becomes significantly longer. Comparative Example 8 is the case of using metal-free phthalocyanine, and in this case, the sensitivity was bad.

Thus, this invention has a superior effect and is very useful.

What is claimed is:

1. A laminate electrophotographic photoreceptor comprising and electroconductive support, a charge-generating layer and a charge-transfer layer, the two layers being placed on the electroconductive support, said charge-generating layer containing a hydroxytitanium phthalocyanine and said charge-transfer layer consisting essentially of a butadiene compound represented by formula (I);

(I)

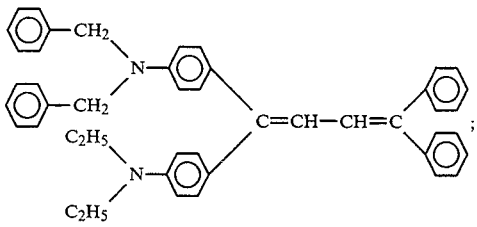

;

a monophenolic antioxidant, the weight ratio of the monophenolic antioxidant/the butadiene compound of formula (I) ranging from 5/95 to 40/80; and an electrically insulating binder.

2. The electrophotographic photoreceptor according to claim 1, wherein the monophenolic antioxidant is 2-tert-butyl-4-methoxyphenol, 2,6-di-tert-butylphenol, 2,6-die-tert-butyl-4-methylphenol, 2,6-di-tert-butyl-4-ethyl-phenol or 2,6-di-tert-butyl-4-methoxyphenol.

3. The electrophotographic photoreceptor according to claim 1, wherein the monophenolic antioxidant is 2,6-di-tert-butyl-4-methylphenol.

4. The electrophotographic photoreceptor according to claim 1, wherein the support is a plate or drum of aluminum or nickel; a plastic film having a vapor-deposited or plated thereon aluminum, copper or nickel; or a sheet or drum of a mixture of a thermoplastic material and an electroconductive powder.

5. The electrophotographic photoreceptor according to claim 1, wherein the weight ratio of the monophenol antioxidant/butadiene compound ranges from 5/95 to 20/80.

6. The electrophotographic photoreceptor to claim 1, wherein the weight ratio of the butadiene compound-/binder ranges from 0.5/1.0 to 1.2/1.0.

7. The electrophotographic photoreceptor according to claim 1, wherein the binder is selected from thermoplastic resins.

8. The electrophotographic photoreceptor according to claim 1, wherein the binder is at least one thermoplastic resin selected from the group consisting of polyester, polycarbonate, polyvinyl chloride, polyvinyl butyral and acrylic resin.

* * * * *